US005934129A

United States Patent [19]

Poloni et al.

[11] Patent Number: 5,934,129

[45] Date of Patent: Aug. 10, 1999

[54] SYSTEM TO CONTROL THE SURFACE PROFILE OF THE BACK-UP ROLLS IN FOUR HIGH ROLLING STANDS AND RELATIVE BACK-UP ROLL

[75] Inventors: Alfredo Poloni, Fogliano Di Redipuglia; Nuredin Kapaj, Udine; Fausto Drigani, Zugliano-Pozzuolo Del Friuli, all of Italy

[73] Assignee: Danieli & C. Officine Meccaniche SpA, Buttrio, Italy

[21] Appl. No.: 09/100,114

[22] Filed: Jun. 19, 1998

[30] Foreign Application Priority Data

Jun. 23, 1997 [IT] Italy ..... G097A0014

[51] Int. Cl.[6] ..... B21B 29/00

[52] U.S. Cl. ..... 72/241.4; 72/252.5; 72/9.2; 72/11.8; 310/26

[58] Field of Search ..... 72/9.5, 10.1, 10.4, 72/13.4, 14.4, 29.1, 241.2, 241.4, 241.6, 252.5, 8.9, 9.1, 9.2, 11.7, 11.8; 335/215; 310/26; 318/118

[56] References Cited

U.S. PATENT DOCUMENTS

| | | | |
|---|---|---|---|
| 3,406,302 | 10/1968 | Lanyi et al. . | |
| 4,017,754 | 4/1977 | Jarett et al. . | |
| 4,612,788 | 9/1986 | Kitagawa . | |
| 4,882,922 | 11/1989 | Dominique | 72/241.6 |
| 4,938,045 | 7/1990 | Rosenstock et al. | 72/14.4 |
| 5,703,553 | 12/1997 | Bushko et al. | 335/215 |

FOREIGN PATENT DOCUMENTS

| | | | |
|---|---|---|---|
| 44222 | 1/1982 | European Pat. Off. | 72/14.5 |
| 2572313 | 5/1986 | France . | |
| 2809809 | 12/1978 | Germany | 72/14.4 |
| 904819 | 2/1982 | U.S.S.R. | 72/10.4 |
| 1039598 | 9/1983 | U.S.S.R. . | |
| 1049128 | 10/1983 | U.S.S.R. . | |
| 1831389 | 7/1993 | U.S.S.R. | 72/10.4 |
| 2187407 | 9/1987 | United Kingdom . | |

OTHER PUBLICATIONS

"Strip Profile Control with Flexible Edge Backup Rolls" Iron & Steel Engineer, vol. 64, No. 7, pp. 23–34, 1987.

*Primary Examiner*—Joseph J. Hail, III
*Assistant Examiner*—Ed Tolan
*Attorney, Agent, or Firm*—Stevens, Davis, Miller & Mosher, L.L.P.

[57] ABSTRACT

System to control the surface profile of the back-up rolls in four-high rolling stands (11) to produce flat products (14), the four-high rolling stand (11) comprising working rolls (12) and back-up rolls, wherein each back-up roll (13) comprises deforming elements (18) consisting of means made of magnetostrictive material (19, 119) on which coils (20, 120) are directly wound and connected with autonomous means of electric supply to generate a magnetic field, the system comprising a control and regulation unit (24), connected with at least means (25) to control the planarity and/or thickness of the rolled product (14) leaving the rolling stand (11), for the controlled activation and feed of each of the coils generating the magnetic field (20, 120). Back-up roll for four-high rolling stands comprising means made of magnetostrictive material to achieve the control system as described above.

19 Claims, 3 Drawing Sheets fig. 3 fig. 4b (A-A)

fig. 4a (A-A)

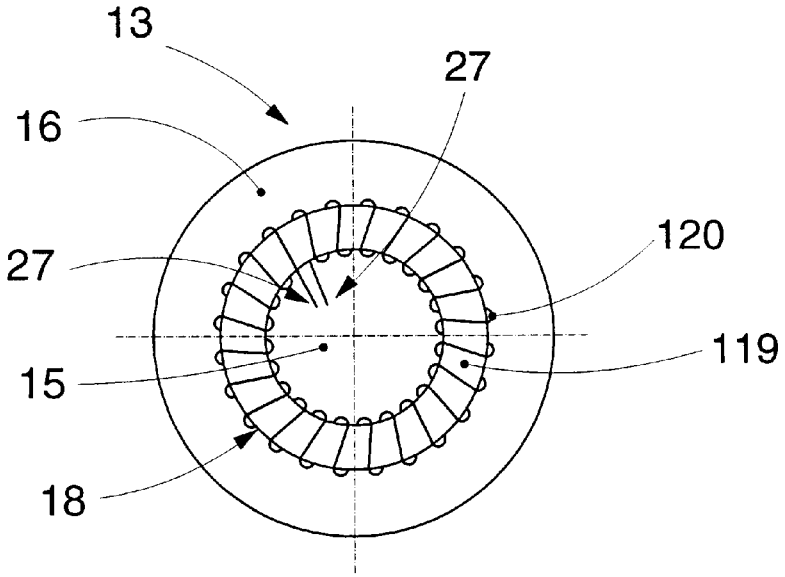
fig. 5a (A-A)
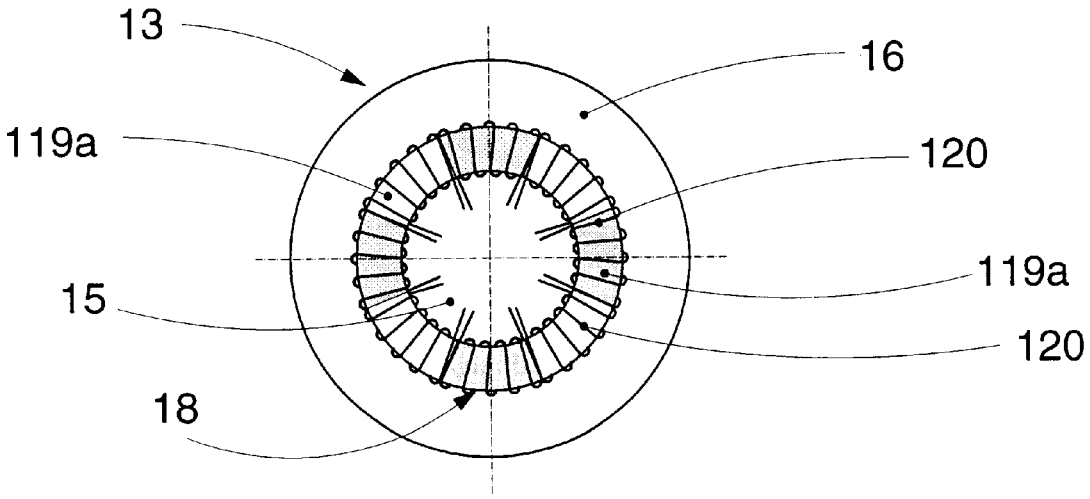
fig. 5b (A-A)

SYSTEM TO CONTROL THE SURFACE PROFILE OF THE BACK-UP ROLLS IN FOUR HIGH ROLLING STANDS AND RELATIVE BACK-UP ROLL

FIELD OF THE INVENTION

This invention concerns a system to control the surface profile of the back-up rolls in four-high rolling stands and the back-up roll used in the said system as set forth in the respective main claims.

The invention is employed in four-high rolling stands for flat products, to set and maintain the determined configuration of the surface profile of the rolling rolls in order to obtain a substantially uniform thickness of the rolled flat product over its entire width.

BACKGROUND OF THE INVENTION

In rolling stands for strip or sheet it is known that a desired deformation has to be made on the working rolls in order to contrast the elastic deflection caused thereon by the rolled stock passing through.

For it is well-known that the behaviour of the working rolls during the rolling process can be likened to a beam constrained at the ends, in such a way that the rolling pressures generate on the rolls a deflection which is greatest in correspondence with the centre and which is a function of the width of the rolled stock.

If this deflection is not compensated, it causes a disuniformity in the thickness and problems with the planarity of the product, both lengthwise and especially widthwise; this situation is more and more unacceptable; given the high standards of quality required by the market.

In order to limit the elastic deflection of the rolls, and still allow working rolls of a small diameter to be used in order to exploit their intrinsic advantages, four-high rolling stands have been proposed wherein each of the two working rolls is associated with a back-up roll.

The back-up rolls transmit the rolling pressure to the relative working rolls and cause a structural strengthening thereof which limits the deformation.

In this type of stand, the deformation which contrasts the deflection of the working rolls is performed on the back-up rolls which, through contact, transmit the deformation to the working rolls themselves.

The different pressures imparted to the working rolls, depending for example on the different width or the type of product which is to be rolled, cause different deformations of the working rolls and therefore it is impossible to mechanically set a curve to the back-up rolls which is optimum for a range of products and for the whole duration of a rolling cycle.

To solve these problems, a plurality of devices of various types have been proposed—mechanical, hydraulic, pneumatic or other—which are able to vary in line, and possibly in a differentiated manner along the width, the surface profile of the back-up rolls according to the requirements of processing.

However, these solutions only give a limited accuracy and are shown to be inadequate in the case of rolled products which are particularly thin and/or with particularly strict parameters of quality.

Moreover, when it is necessary to correct the configuration of the profile of the back-up rolls during the rolling cycle, it takes a long time to carry out this correction, and therefore it causes a long section of rolled stock to be produced which is unacceptable in quality.

SU-A-1039598 describes a rolling roll comprising means to adjust the profile consisting of electric windings and magnetostrictive converters, that is to say, made of material suitable to be deformed if it is subjected to the action of a variable magnetic field.

The roll comprises a rotation shaft on which the electric windings are attached and a sleeve within the body of which the magnetostrictive converters are located, arranged in concentric rings around the rotation shaft.

This reciprocal configuration of the electric windings and the magnetostrictive rings has the disadvantage that the density of the magnetic field generated is not uniform over all the sections of the magnetostrictive ring and moreover the lines of force are arranged on the ring in an incorrect way.

Moreover, because of the dispersion of the lines of force there is a deterioration, apart from a lack of uniformity, in the effect of mechanical deformation of the magnetostrictive rings.

These disadvantages are even more serious if we consider that it is necessary to control the profile of the rolls with absolute precision, given that an imprecise control has serious consequences on the planarity and uniformity of the surface of the rolled stock.

The present applicant has designed, tested and embodied this invention to overcome the shortcomings of the state of the art and to achieve further advantages.

SUMMARY OF THE INVENTION

The invention is set forth and characterised in the respective main claims, while the dependent claims describe variants of the idea of the main embodiment.

The purpose of the invention is to provide a system which will give an accurate regulation and a constant control of the configuration of the profile of the back-up rolls, and therefore of the mating working rolls, in four-high rolling stands, in order to obtain a rolled flat product of optimum quality.

A further purpose of the invention is to obtain a system which will allow rapid variations to be made in line, substantially in real time, to the configuration of the profile of the back-up rolls, the variations being correlated to the geometric and dimensional characteristics of the product leaving the rolling stand.

The system according to the invention includes the use of back-up rolls made at least partly of magnetostrictive material, which is able to modify its molecular structure, and therefore to increase/decrease its volume, if subjected to the action of a magnetic field.

According to a first embodiment of the invention, the back-up rolls comprise a core inside which the rotation shaft is arranged, an outer covering and an intermediate layer defining an annular space wherein are housed, in contact with the outer covering, a plurality of deforming elements consisting of magnetostrictive bars arranged radially and associated with relative coils which generate the magnetic field.

The magnetostrictive bars may be of any shape whatsoever which is compatible with the spaces available and with the structure of the roll.

According to a first embodiment, on each magnetostrictive bar a relative coil is wound, the ends of which are connected to electric supply means, each coil being able to be fed independently and autonomously from the other.

According to a variant, a coil is wound around a defined number of magnetostrictive bars.

In another variant, the deforming elements, consisting of the radial bars arranged between the inner core and the outer lining, are gathered in a ring around the whole circumference of the section of the inner core, there being a plurality of these ring-shaped collections distanced and distributed along the length of the roll.

Between one radial bar and the adjacent one there is a space.

According to another embodiment, the deforming elements consist of rings made of magnetostrictive material, distributed along the length of the roll; a relative coil is wound onto the rings.

According to a variant of this embodiment, each ring is divided into sectors, onto each of which a respective coil is wound, fed independently from the other coils.

According to the invention, the influence of a magnetic field causes a variation in size of the magnetostrictive rings or bars, particularly in a lengthwise or in a radial direction.

This variation in size causes radial thrusts which deform the outer covering of the back-up rolls and therefore vary their surface profile.

By modulating the current fed to each coil, or to each group of coils, it is possible to cause differentiated and controlled variations in size, both in terms of time and in terms of space over the length of the roll, according to the requirements of the rolling cycle.

Since the coils are wound directly onto the magnetostrictive deforming elements and rotate together the same, the density of the magnetic field generated on the sections of the elements is extremely uniform.

Moreover, the lines of force of the magnetic field are opportunely arranged uniformly, in a radial direction with respect to the axis of the roll, which makes the deformation of the magnetostrictive element more efficient.

Moreover, there is a reduced dispersion of the lines of force of the field, which close almost completely on the magnetostrictive element.

According to the invention, the correct setting of the configuration of the back-up rolls is determined by a control and regulation unit which, according to signals received by sensors located at the outlet of the rolling stand, causes the deformation of the back-up rolls to be distributed in a desired manner.

To be more exact, the sensors monitor the thickness of the rolled stock over its whole width and condition the differentiated activation of the specific coils in such a way as to obtain the desired configuration of the back-up roll.

These variations to the configuration of the back-up rolls are extremely accurate and immediate, and thus it is possible to make corrections to the profile of the rolls substantially in real time, with response times in the order of 50 milliseconds, even during the rolling cycle.

BRIEF DESCRIPTION OF THE DRAWINGS

The attached Figures are given as a non-restrictive example, and show in diagram form some preferential embodiments of the invention, as follows:

FIG. 4*a* shows the section from "A" to "A" of FIG. 3;

FIG. 4*b* shows a variant of FIG. 4*a*.

FIG. 5*a* shows another variant of FIG. 4*a;*

FIG. 5*b* shows a variant of FIG. 5*a*.

DETAILED DESCRIPTION OF THE PREFERRED EMBODIMENT

Figure 1:
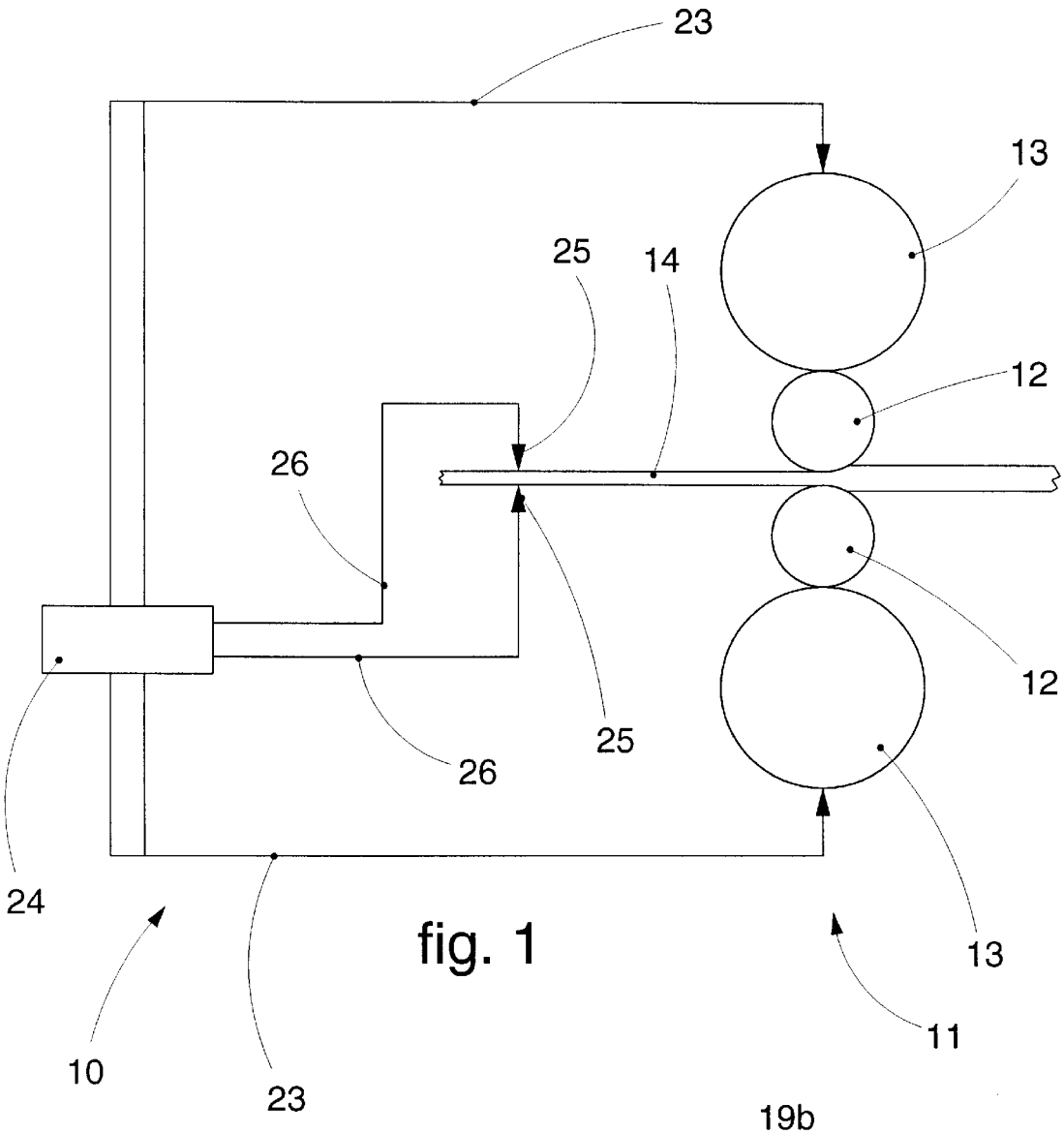
FIG. 1 shows in diagram form a four-high rolling stand using the system according to the invention.

With reference to the attached figures, the number 10 denotes the overall system according to the invention to control the surface profile of the back-up rolls 13 in four-high rolling stands 11.

To be more exact, the system 10 makes it possible to deform the surface of the back-up rolls 13 at specific localised points, with a consequent transmission of this deformation to the working rolls 12, in order to contrast the deformations which derive from the thrusts of the rolled stock 14 as it passes through and to obtain a better control of the planarity and thickness of the said rolled stock 14.

The back-up rolls 13 and the working rolls 12 have their respective axes of rotation lying on a single plane perpendicular to the rolling plane defined by the working rolls 12.

The system 10, which is shown diagrammatically in FIG. 1, provides back-up rolls 13 comprising elements made of magnetostrictive material.

In this case, the back-up rolls 13 comprise an inner core 15, made of rigid and non-deformable material and containing the rotation shaft, an outer covering 16, made of conventional material which can be at least partly deformed, and a space 17 between the inner core 15 and the outer covering 16.

Inside the space 17 there is a plurality of deforming elements 18 arranged radially around the inner core 15.

Figure 3:
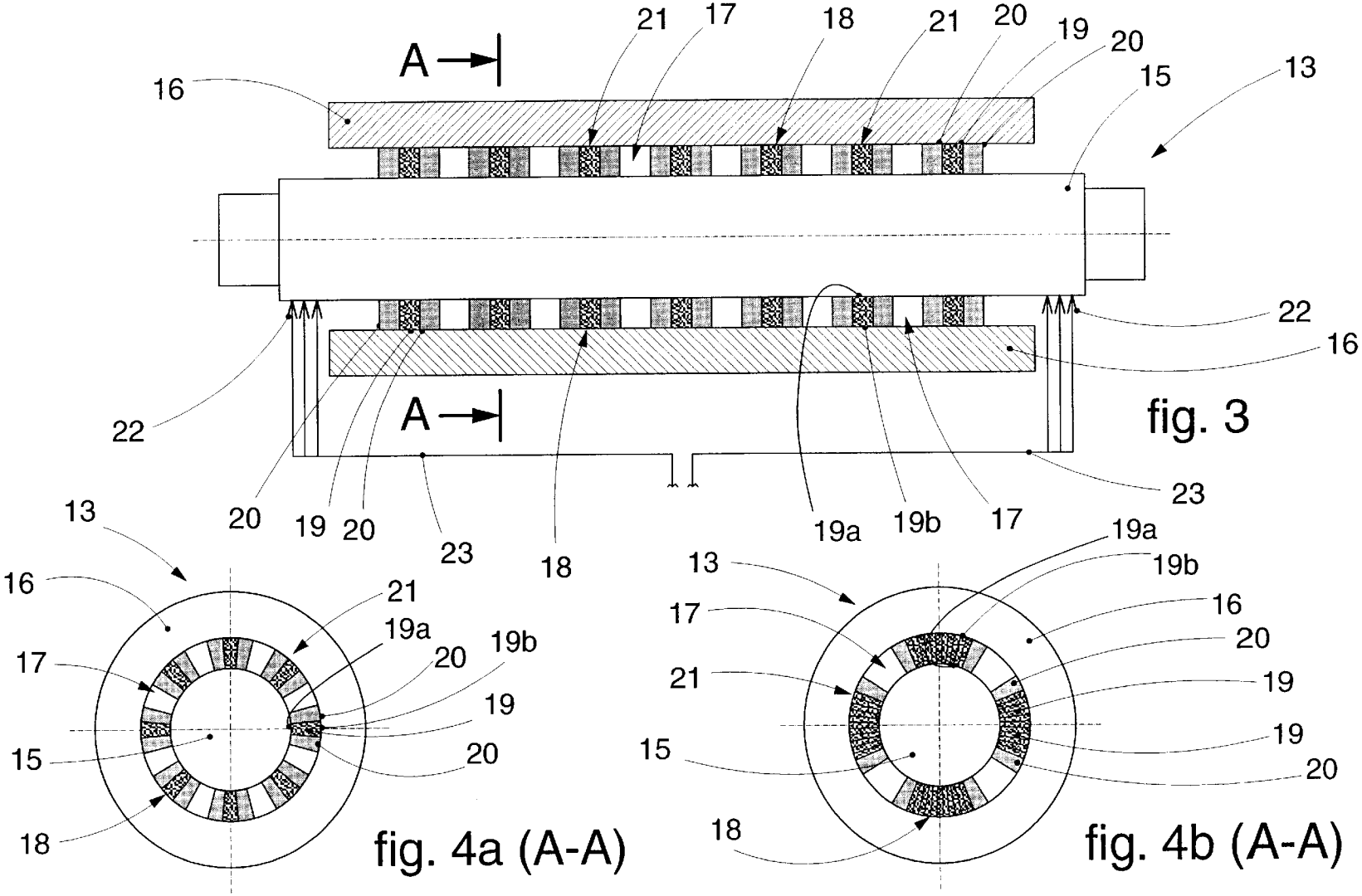
FIG. 3 shows a lengthwise cross section of a back-up roll according to the invention.

Each of the deforming elements 18, in the embodiments shown in FIGS. 3, 4*a*, 4*b*, consists of at least a magnetostrictive bar 19, on the lateral surface of which a coil 20 is wound.

In FIG. 4*a*, on each magnetostrictive bar 19 a relative coil 20 is wound.

In the variant shown in FIG. 4*b*, on a determined number of magnetostrictive bars 19 arranged adjacent, a single coil 20 is wound.

The magnetostrictive bars 19 are arranged in contact with the inner core 15 and the outer covering 16 in correspondence respectively with the heads 19*a* and 19*b*.

In this case, the deforming elements 18 are arranged in annular groups 21 substantially parallel to each other and separated lengthwise so as to cover a substantial part of the length of the back-up rolls 13 (FIG. 3)

In the variant shown in FIG. 5*a*, the deforming elements 18 consist of rings 119 made of magnetostrictive material which occupy the entire space 17 between the inner core 15 and the outer covering 16.

Onto each ring 119 a respective coil 120 is wound, the ends 27 of which are connected to supply means.

A plurality of rings 119 are arranged along the length of the roll 13 so as to cover a substantial part thereof; on each of the rings 119 a respective coil 120 is wound, the coils 120 can be fed independently from each other In the further variant shown in FIG. 5*b*, the rings are divided into sectors 119*a*, on each of which a respective coil 120 is wound, which can be fed independently of the other coils 120 of the same ring or of different rings.

Due to the characteristics of the magnetostrictive material, the bars 19 or the rings 119 undergo a variation in size if immersed in a magnetic field.

Figure 2:
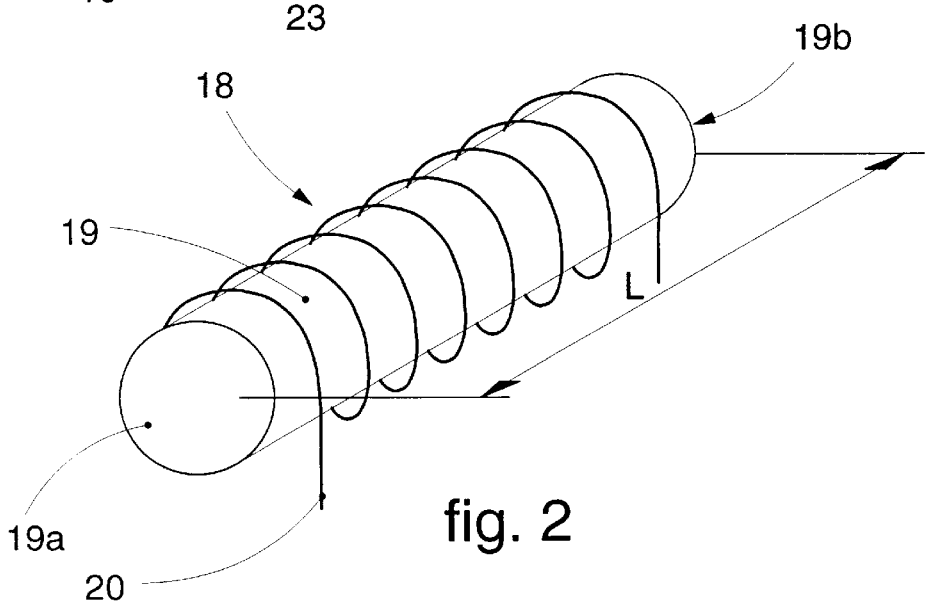
FIG. 2 shows a component of the back-up rolls according to the invention.

This variation of size is more accentuated along the length "L" of the magnetostrictive bars 19 (FIG. 2), or in a radial direction to the ring 119, while it is substantially negligible in the transverse direction.

The variation in size gives rise to an axial thrust of the magnetostrictive bars 19 or of the sections of the ring 119 which acts on the outer covering 16 and causes a localised deformation thereof, also due to the contrast caused by the inner core 15

The invention provides the controlled and possibly differentiated supply of power to the individual coils 20 of each deforming element 18, or to the coils 20, 120 associated with each individual annular group 21 or with each ring, so as to cause a localised deformation of the outer covering 16, in the direction of the length of the back-up roll 13, according to the specific necessities dictated by the rolling cycle.

Power is supplied to the coils 20, 120 by means of revolving or sliding contacts 22, connected to the relative supply circuits 23.

The revolving or sliding contacts 22, in this case, act on circuits made on the inner core 15 and associated with the coils 20, 120.

In this case, the supply of power to the coils 20, 120 is regulated by a control and regulation assembly 24 (FIG. 1).

To be more exact, the control and regulation assembly 24 acts in feedback according to information supplied by sensors 25 placed at the outlet of the four-high rolling stand 11 and suitable to monitor the planarity and the thickness of the rolled stock 14 leaving the four-high rolling stand 11.

This information is sent by means of inlet circuits 26 to the control and regulation assembly 24 which regulates in a differentiated manner the intensity of the current circulating in each coil 20, 120 so as to define the most suitable configuration for the back-up rolls 13.

In this way it is possible to determine a concave or convex curve of the back-up rolls 13 by feeding the coils 20, 120 of the central annular groups 21 or rings 119 respectively with an electric current of greater or lesser intensity with respect to the coils 20, 120 of the outer annular groups 21 or rings 119.

In the same way, it is possible to set other, different configurations of the back-up rolls 13 by feeding in a differentiated manner the individual annular groups 21 or rings 119 or the individual coils 20, 120 thereof.

Therefore the invention makes it possible to correct, substantially continuously and in real time, the configuration of the back-up rolls 13, in such a way as to allow rolled stock 14 to be obtained which is characterised by high standards of quality in terms of planarity and uniformity of thickness.

The direct winding of the coils 20, 120 and the rotation of the coils 20, 120 as a single body with the relative magnetostrictive deforming elements guarantees a uniform density of the magnetic field, minimum dispersion and an optimum arrangement of the lines of force of the field.

We claim:

1. A system to control the surface profile of back-up rolls in a four-high rolling stand (11) to produce flat products (14), comprising:

a four-high rolling stand (11) comprising a pair of working rolls and a pair of back-up rolls (13), said pair of working rolls (12) defining a rolling plane, said pair of working rolls (12) cooperating with the respective back-up rolls (13) whose axis of rotation is parallel to the axis of rotation of the working rolls (12), the axes of the working rolls (12) and of the back-up rolls (13) lying on a common plane at a right angle to the rolling plane, each back-up roll (13) comprising a core (15) associated with a rotation shaft and an outer covering (16), between the core (15) and the outer covering (16) there being included an annular space (17), each back-up roll (13) comprising deforming elements (18) comprising magnetostrictive material (19, 119) and arranged to occupy at least partly the annular space (17), coils (20, 120) being wound directly on the magnetostrictive material and connected with autonomous means of electric supply to generate a magnetic field, the system comprising a control and regulation unit (24), connected with means (25) to control at least one parameter selected from the group consisting of the planarity and the thickness of the rolled product (14) leaving the rolling stand (11), for the controlled activation and feed of each of the coils generating the magnetic field (20, 120).

2. The system as in claim 1, wherein said deforming elements are made of said magnetostrictive material.

3. A back-up roll (13) for four-high rolling stands (11) to produce flat products (14), the four-high rolling stand (11) comprising a pair of working rolls (12) and a pair of said back-up rolls (13), the working rolls (12) defining the rolling plane and cooperating with the respective back-up rolls (13) whose axis of rotation is parallel to the axis of rotation of the working rolls (12), the axes lying on a common plane perpendicular to the rolling plane, the back-up roll (13) comprising:

an inner core (15) made of a substantially rigid and non-deformable material, an outer covering (16) made of an at least partly elastic and deformable material and an annular space (17) defined between the inner core (15) and the outer covering (16), a plurality of deforming elements (18) being included in the space (17) arranged in contact with the outer covering (16), each of the deforming elements (18) comprising magnetostrictive material, on each of the deforming elements (18) there being directly wound a respective coil (20) to generate a magnetic field connected to autonomous means of electric supply, the coils (20) being governed individually or in groups by a unit (24) to control and regulate the power supply.

4. The back-up roll as in claim 3, wherein the deforming elements (18) consist of magnetostrictive bars (19), having heads **(19, 19*a*) and sidewalls, arranged radially in the annular space (17) around the inner core (15)**.

5. The back-up roll as in claim 4, wherein the magnetostrictive bars (19) are arranged with their heads **(19*a*, 19*b*) respectively in contact with the inner core (15) and with the outer covering (16)**.

6. The back-up roll as claim 4, wherein on each magnetostrictive bar (19) a respective said coil (20) is wound.

7. The back-up roll as in claim 4, wherein said coil (20) winds on a determined number of magnetostrictive bars (19) which are adjacent to each other.

8. The back-up roll as in claim 4, wherein on each magnetostrictive bar (19), a respective said coil (20) is wound on the sidewalls of the bar (19).

9. The back-up roll as in claim 4, wherein said coil (20) is wound on the sidewalls of a determined number of said magnetostrictive bars (19) which are adjacent to each other.

10. The back-up roll as in claim 3, wherein the magnetostrictive bars (19) are arranged in annular groups (21) developing substantially over the whole circumference of the inner core (15), the annular groups (21) being separated lengthwise over a substantial part of the length of the inner core (15).

11. The back-up roll as in claim 3, wherein the deforming elements (18) comprise rings (119) arranged in the annular space (17) between the inner core (15) and the outer covering (16) and distributed along the length of the roll, on each of the rings (119) there being wound a respective said coil (20) to generate the magnetic field and be associated with autonomous supply means.

12. The back-up roll as in claim 11, wherein each ring (119) is sub-divided into sectors **(119*a*) on each of which a respective said coil (20)** is wound to generate a magnetic field and associated with autonomous supply means.

13. The back-up roll as in claim 3, wherein said deforming elements are made of said magnetostrictive material.

14. The back-up roll as in claim 3, wherein the deforming elements (18) comprise magnetostrictive bars (19), having heads **(19, 19*a*) and sidewalls, arranged radially in the annular space (17) around the inner core (15)**.

15. The back-up roll as in claim 3, wherein the deforming elements (18) comprise rings (119) arranged in the annular space (17) between the inner core (15) and the outer covering (16) and distributed along the length of the roll, on each of the rings (119) there being wound a respective said coil (20) to generate the magnetic field and be associated with autonomous supply means.

16. The back-up roll as in claim 5, wherein on each magnetostrictive bar (19) a respective said coil (20) is wound.

17. The back-up roll as in claim 5, wherein the magnetostrictive bars (19) are arranged in annular groups (21) developing substantially over the whole circumference of the inner core (15), the annular groups (21) being separated lengthwise over a substantial part of the length of the inner core (15).

18. The back-up roll as in claim 6, wherein the magnetostrictive bars (19) are arranged in annular groups (21) developing substantially over the whole circumference of the inner core (15), the annular groups (21) being separated lengthwise over a substantial part of the length of the inner core (15).

19. The back-up roll as in claim 7, wherein the magnetostrictive bars (19) are arranged in annular groups (21) developing substantially over the whole circumference of the inner core (15), the annular groups (21) being separated lengthwise over a substantial part of the length of the inner core (15).

* * * * *